US006051148A

United States Patent [19]

Perry et al.

[11] Patent Number: 6,051,148

[45] Date of Patent: Apr. 18, 2000

[54] PHOTORECEPTOR FABRICATION METHOD

[75] Inventors: Philip G. Perry, Webster; William G. Herbert, Williamson; Alexandra I. Vidal, Webster; Gene W. O'Dell; Cornelius Boerman, both of Williamson; James E. McNamara, Sodus, all of N.Y.

[73] Assignee: Xerox Corporation, Stamford, Conn.

[21] Appl. No.: 09/035,442

[22] Filed: Mar. 5, 1998

[51] Int. Cl.[7] ..... C23F 1/36

[52] U.S. Cl. ..... 216/24; 216/37; 216/102

[58] Field of Search ..... 216/102, 24, 37

[56] References Cited

U.S. PATENT DOCUMENTS

| | | | |
|---|---|---|---|
| 3,907,650 | 9/1975 | Pinsler | 204/34 |
| 4,076,564 | 2/1978 | Fisher | 156/664 |
| 4,134,763 | 1/1979 | Fujimura et al. | 96/1.5 R |
| 4,559,279 | 12/1985 | Honjo et al. | 428/632 |
| 4,618,552 | 10/1986 | Tanaka et al. | 430/60 |
| 4,741,918 | 5/1988 | Nagy de Nagybaczon et al. | 427/11 |
| 4,904,557 | 2/1990 | Kubo | 430/56 |
| 5,051,328 | 9/1991 | Andrews et al. | 430/56 |
| 5,096,792 | 3/1992 | Simpson et al. | 430/58 |
| 5,188,916 | 2/1993 | Hodumi et al. | 430/65 |
| 5,219,691 | 6/1993 | Fukuda et al. | 430/58 |
| 5,252,422 | 10/1993 | Okano et al. | 430/131 |
| 5,429,715 | 7/1995 | Thomas et al. | 216/103 |
| 5,573,445 | 11/1996 | Rasmussen et al. | 451/39 |

*Primary Examiner*—Benjamin L. Utech
*Assistant Examiner*—Charlotte A. Brown
*Attorney, Agent, or Firm*—Zosan S. Soong

[57] ABSTRACT

A photoreceptor fabrication method involving a photoreceptor substrate having a metal surface, comprising etching the metal surface of the photoreceptor substrate with an etching solution and forming a metal oxide layer on the metal surface with the etching solution, wherein the etching of the metal surface and the forming of the metal oxide layer are conducted in the absence of an electric current.

14 Claims, 3 Drawing Sheets

PHOTORECEPTOR FABRICATION METHOD

FIELD OF THE INVENTION

This invention relates to a photoreceptor fabrication method, particularly one that employs an etching solution to reduce or eliminate the interference-fringe effect within a photoreceptor.

BACKGROUND OF THE INVENTION

This invention relates to the fabrication of photoreceptors suitable for application to xerographic printers and like machines that use coherent light sources. More particularly, this invention relates to a multilayered photoreceptor having a designated substrate surface roughness that minimizes or eliminates an interference-fringe print defect in the resulting printer output where there is absent an undercoat layer between the substrate surface and a metal oxide layer over the substrate. In the present invention, the metal oxide layer is not considered an undercoat layer.

Xerographic printers and like machines that use multilayered photoreceptors in conjunction with a coherent light source suffer from an interference effect that manifests as a printable defect that can be described as a series of dark and light interference fringes that resemble wood grains. The use of coherent illumination sources in conjunction with multilayered photoreceptors produces the interference effect through the interaction between various reflected components of the incident light whose difference in optical path length varies from one area of the photoreceptor to another. Such spatial variation in the optical path length arises because the coated layers have inherent spatial thickness variations imposed by limitations in the coating process. The spatial variation in the optical path length in turn produces absorption variation in the charge generating layer of the photoreceptor, resulting in the interference-fringe defect in prints generated by these xerographic machines.

FIG. 1 is a schematic view of a typical photoreceptor of a multilayered design. In FIG. 1, the photoreceptor 10 includes a substrate 1, an undercoat layer 2, a charge generating layer 3, and a charge transport layer 4.

In this device, which comprises three organic layers 2–4 coated on a metallic substrate 1, an incident light beam 5 is directed at the charge transport layer 4. The primary light beam 5 is then reflected from the planes that define interfaces 7, 9A, 9B and 9C between the layers 1–4 of the multilayered photoreceptor. More specifically, reflected light beam 6 is generated via reflection from the interface 7 between the atmospheric air and the charge transport layer 4, reflected light beam 8A is generated via reflection from the interface 9A between the charge transport layer 4 and the charger generating layer 3, reflected light beam 8B is generated via reflection from the interface 9B between the charge generating layer 3 and the undercoat layer 2, and reflected light beam 8C is generated via reflection from the interface 9C between the undercoat layer 2 and the substrate 1. The primary reflections that contribute to the interference-fringe print defect producing interference effect are the reflected beam 6 generated at the interface 7 between the surrounding atmospheric air and the charge transport layer 4 and the reflected beam 8C from the interface 9C between the undercoat layer 2 and the substrate 1, where the differences in optical indices are the greatest.

Methods have been proposed to suppress the charge transport layer/air interface specular reflection, including roughening of the charge transport layer surface by introducing micron size $SiO_2$ dispersion and other particles into the charge transport layer, applying an appropriate overcoating layer and the like.

Methods have also been proposed to suppress the intensity of substrate surface specular reflection, e.g., coating specific materials such as anti-reflection materials and light scattering materials on the substrate surface and roughening methods such as dry blasting and liquid honing of the substrate surface. However, such methods must achieve their primary objective of eliminating substrate surface reflections without adversely impacting the electrical parameters or print quality of photoreceptors into which they are incorporated.

Patents on interference-fringe effect suppression include U.S. Pat. No. 5,219,691 to Fukuda et al., U.S. Pat. No. 4,618,552 to Tanaka et al., U.S. Pat. No. 4,741,918 to Nagy de Nagybaczon et al., U.S. Pat. No. 4,904,557 to Kubo et al, U.S. Pat. No. 4,134,763 to Fujimura et. al., U.S. Pat. No. 5,096,792 to Simpson et al., and U.S. Pat. No. 5,051,328 to Andrews et al.

A typical liquid honing process, described for example in Rasmussen et al., U.S. Pat. No. 5,573,445, is a technique to create a highly scattered surface on a metallic substrate, and is used in some multilayered devices to eliminate the interference-fringe effect. A liquid honing process, however, is disadvantageous in certain situations because it may require a relatively thick undercoat layer in the photoreceptor and the liquid honing process is an extra step after diamond lathing which thereby increases the cost of production of a substrate.

The present invention renders optional an undercoat layer described in more detail below, thereby decreasing the photoreceptor fabrication cost. In the present invention, a metal oxide layer is not considered an undercoat layer because the metal oxide layer is an integral part of the substrate and it is not coated onto the substrate. In typical multilayered photoreceptors, a resin layer is required to be inserted as an undercoat layer between the substrate and the photosensitive layers in order to provide a charge blocking capability, mechanical adhesion strength between the substrate and the photosensitive layers, and improved cyclic stability. Each undercoat layer (also referred herein as an intermediate layer) may be any layer conventionally employed between the substrate and the photosensitive layer as illustrated for example in Tanaka et al., U.S. Pat. No. 4,618,552 and Andrews et al., U.S. Pat. No. 5,051,328, the disclosures of which are totally incorporated herein by reference. Accordingly, the undercoat or intermediate layer may be a subbing layer, barrier layer, adhesive layer, and the like. The intermediate layer may be formed of, for example, a mixture of acetyl acetone zirconium tributoxides, and gamma amino propyltriethoxy silane, casein, polyvinyl alcohol, nitrocellulose, ethyleneacrylic acid copolymer, polyamide (nylon 6, nylon 615, nylon 610, copolymerized nylon, alkoxymethylated nylon, and the like), polyurethane, gelatin, and the like. If needed, a separate adhesive layer may be added between the intermediate layer and the subsequently applied layers to improve adhesion. Typical adhesive layers include film-forming polymers such as polyester, polyvinylbutyral, polyvinylpyrrolidone, polycarbonate, polyurethane, polymethyl methacrylate, and the like as well as mixtures thereof. The intermediate layer may be deposited by any conventional means such as dip coating, spray coating, and vapor deposition and preferably has a thickness of from about 0.05 to about 5 microns.

Typical undercoat resin layers, however, exhibit poor environmental cyclic stability due to the fact that the volume resistivity of a resin greatly depends on the ionic conductivity and is strongly affected by temperature and humidity conditions. Many proposals have been made to form an undercoat layer using organic metal compounds or silane coupling agents to improve upon the environmental effects. U.S. Pat. No. 5,252,422 to Okano et al. and U.S. Pat. No. 5,188,916 to Hodumi et al.,for example, discuss the use of organic metal chelate compounds or organic metal alkoxide compounds with silane coupling agents as an improved undercoat layer in a multilayered photoreceptor for visible light xerographic applications. When this type of an undercoat material is used in combination with a roughened substrate for interference fringe suppression for printer applications where a coherent exposure light source is used, an addition of a resin is required to increase the thickness of the undercoat layer to ensure continuous coverage to avoid charge injection from the substrate. Examples of a print defect caused by charge injection from the substrate include a cluster of black spots in white background in a discharge area development (DAD) system, which are commonly known as "pepper spots." Thick undercoat layers, however, produce undesirable electrical effects including a high residual voltage build up and poor cyclic stability.

Thus, there is a need, which the present invention addresses, for a new photoreceptor design that minimizes or suppresses the interference-fringe effect while maintaining good performance characteristics.

SUMMARY OF THE INVENTION

The present invention is accomplished in embodiments by providing a photoreceptor fabrication method involving a photoreceptor substrate having a metal surface, comprising etching the metal surface of the photoreceptor substrate with an etching solution and forming a metal oxide layer on the metal surface with the etching solution, wherein the etching of the metal surface and the forming of the metal oxide layer are conducted in the absence of an electric current.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 2:
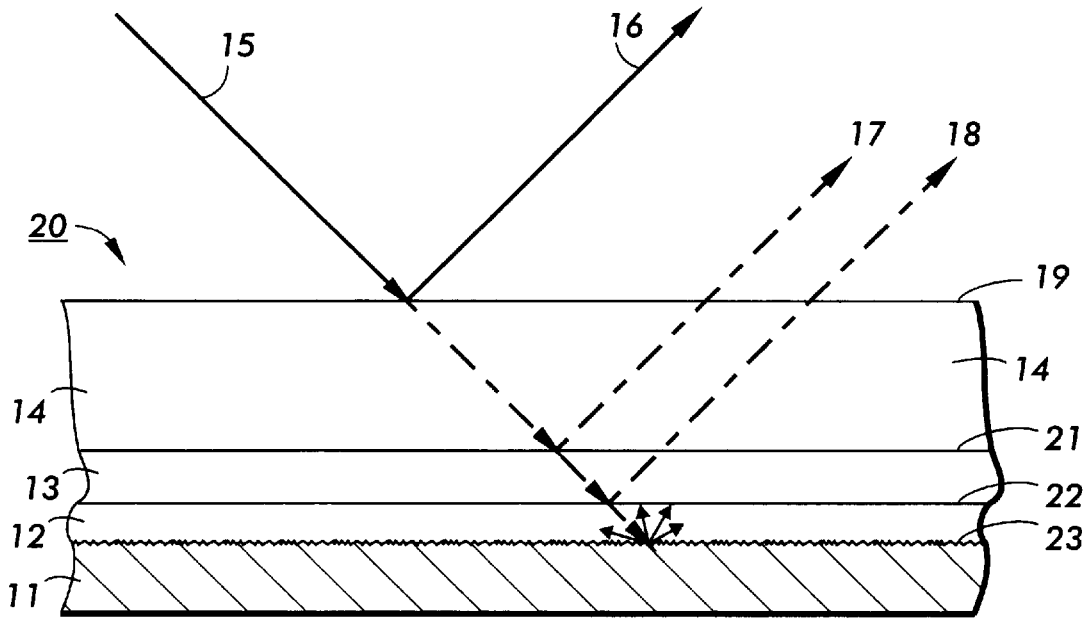
FIG. 2 is a schematic cross-sectional view of the photoreceptor fabricated according to the present invention.

FIG. 2 is a schematic cross sectional view of an illustrative photoreceptor fabricated by the present invention. A multilayered photoreceptor 20 includes a substrate 11, a metal oxide layer 12 overlaying the substrate, a charge generating layer 13 overlaying the metal oxide layer, and a charge transport layer 14 overlaying the charge generating layer 13. The present invention is advantageous since it offers one or more of the following: avoiding the use of an undercoat layer which reduces costs; avoiding a liquid honing step after diamond lathing of the substrate in situations where liquid honing is currently used, thereby reducing costs; minimizing or eliminating the interference-fringe effect; and minimizing or eliminating a print defect involving black spots.

The conductive substrate is typically aluminum or an aluminum alloy and generally cylindrical in shape, and is cleaned by any suitable technique after the surface morphology of the substrate is formed. Other types of conductive materials including other metals and metal alloys such as stainless steel brass, nickel and the like can be also employed as a substrate. If diamond lathing is used to create the desired surface roughness, the lathing lubricants and any foreign substances introduced to the substrate surface during the diamond lathing process are removed by subsequent cleaning procedures. Although FIG. 2 is intended to portray a cross-sectional view of a cylindrical substrate, any substrate geometry such as a hollow or solid cylinder, a flat sheet, a seamed or unseamed belt, or any other form that allows conventional coating techniques such as dip coating, vapor deposition, spray coating, and the like can be used.

A metal oxide layer is formed on the substrate by the present method using an etching solution in an electroless manner. The metal oxide layer may be aluminum oxide or nickel oxide. Preferably, the metal oxide layer contains the same metal as the predominant metal at the surface of the substrate. The metal oxide layer may function in embodiments as a charge blocking layer. The thickness of the metal oxide layer resulting from the etching solution falls within a range of from about 10 to about 200 angstroms, and preferably from about 100 to about 200 angstroms.

The etching solution is preferably used subsequent to the lathing of the substrate surface. The desired extent of etching can be determined by trial and error. The etching of the substrate surface is conducted in an electroless manner. The etching of the substrate surface and the formation of the metal oxide layer may occur almost simultaneously.

In embodiments, the etching solution may be composed of sodium citrate at a concentration ranging for example from about 1% to about 10%, preferably about 5% by weight. The following procedure illustrates the present method for etching the substrate surface and for forming the metal oxide layer when employing sodium citrate in the etching solution. The substrate is first rinsed with deionized water to remove any residual aqueous machining fluid, then immersed in the etching solution, which is maintained at a constant temperature between about 70 to about 90° C., preferably about 80° C. Immersion times ranging for example from about 30 seconds to about 3 minutes, preferably about 1 minute, may be used depending on the degree of etching desired. Next, the substrate is immediately rinsed with ambient deionized water for about 0.5 minute to about 3 minutes and allowed to dry. Elevated temperatures may be used to expedite drying. Sodium citrate is desirable as an etchant since it is effective at a pH of less than 9. This quality allows the etching solution containing the sodium citrate to be disposed of without the need for neutralization. As the bath is used, the pH increases can be maintained in the neutral range using the derivative compound citric acid. Additions of surfactants, preferably nonionics, may be made to promote cleaning as well as etching. Examples of surfactants which would enable cleaning include for example ethoxylated alcohols such as Plurafac A; ethoxylated alkyl phenols such as Triton X-114; and Sorbitan derivatives such as PSML-20.

In other embodiments, the etching solution contains sodium carbonate (preferably 3% by weight), sodium borate (preferably 3% by weight), and sodium hydroxide (preferably 1% by weight). The following procedure illustrates the present method for etching the substrate surface and for forming the metal oxide layer when employing sodium carbonate, sodium borate, and sodium hydroxide in the etching solution. The substrate is first rinsed with deionized water to remove any residual aqueous machining fluid, then immersed in the etching solution, which is maintained at a constant temperature between about 90 to about 120° F. for about 30 seconds to about 3 minutes. Similar results may be obtained by eliminating the sodium hydroxide and increasing the solution temperature and/or the immersion time. Next, the, substrate is immediately rinsed with ambient deionized water for about 0.5 minute to about 3 minutes and allowed to dry. Elevated temperatures may be used to expedite drying.

To increase the thickness of the metal oxide layer, the metal oxide layer can be exposed to an elevated temperature ranging for example from about 100 to about 300° C. for a time ranging for instance from about 30 seconds to about 10 minutes, preferably from about 30 to about 180 seconds. This procedure may increase the thickness of the metal oxide layer by an amount ranging for example from about 20% to about 200% as compared with a metal oxide layer not subjected to this elevated temperature procedure. The metal oxide layer resulting from exposure to the elevated temperature procedure may have a thickness of about 6 to about 30 angstroms. Etchants such as depolarized weak acids which produce a finely pitted surface are preferred. Examples of depolarized weak acids include solutions of low concentration acids and corresponding strong base salts such as: 1–10% by volume HCl plus 1–10% by weight NaCl; 1–10% by volume $H_2SO_4$ plus 1–10% by weight $Na_2SO_4$; 1–10% by volume $HNO_3$ plus 1–10% by weight $NaNO_3$.

In embodiments, a charge transport layer 14 and a charge generating layer 13 comprise the photosensitive layers. This is referred to as a laminate type photosensitive material Charge transport and charge generating layers may be deposited by any suitable conventional technique including dip coating, spray coating, and vapor deposition and are well known in the art as illustrated for example in U.S. Pat. No. 4,390,611, U.S. Pat. No. 4,551, 404, U.S. Pat. No. 4,588, 667, U.S. Pat. No. 4,596,754, and U.S. Pat. No. 4,797,337, the disclosures of which are totally incorporated herein by reference. In embodiments, the charge generating layer 13 may be formed by dispersing a charge generating material selected from commercially available azo pigments such as Sudan Red, Dian Blue, Janus Green B, and the like; quinone pigments such as Algol Yellow, Pyrene Quinone, Indanthrene Briliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, oxytitanium phthalocyanine, chloroindium phthalocyanine and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the charge transport layer may be formed by dissolving a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

In embodiments, the photosensitive material may be of a single-layer type comprising the charge generating material charge transporting material, and the binder resin, wherein these three materials may be as described above. Single layer type photosensitive materials may be deposited by any suitable technique including dip coating and vapor deposition and are illustrated, for example, in Mutoh et al., U.S. Pat. No. 5,004,662 and Nishiguchi et al., U.S. Pat. No. 4,965,155, the disclosures of which are totally incorporated herein by reference.

In operation, an incident light beam 15 is reflected from various layers of the multilayered photoreceptor. In particular, a reflected beam 16 is generated from the interface 19 between the charge transport layer 14 and the atmospheric air surrounding the photoreceptor, a beam 17 is generated from the interface 21 between the charge generating layer 13 and the charge transport layer 14, and a beam 18 is produced by the interface 22 between the charge generating layer 13 and the metal oxide layer 12.

Figure 1:
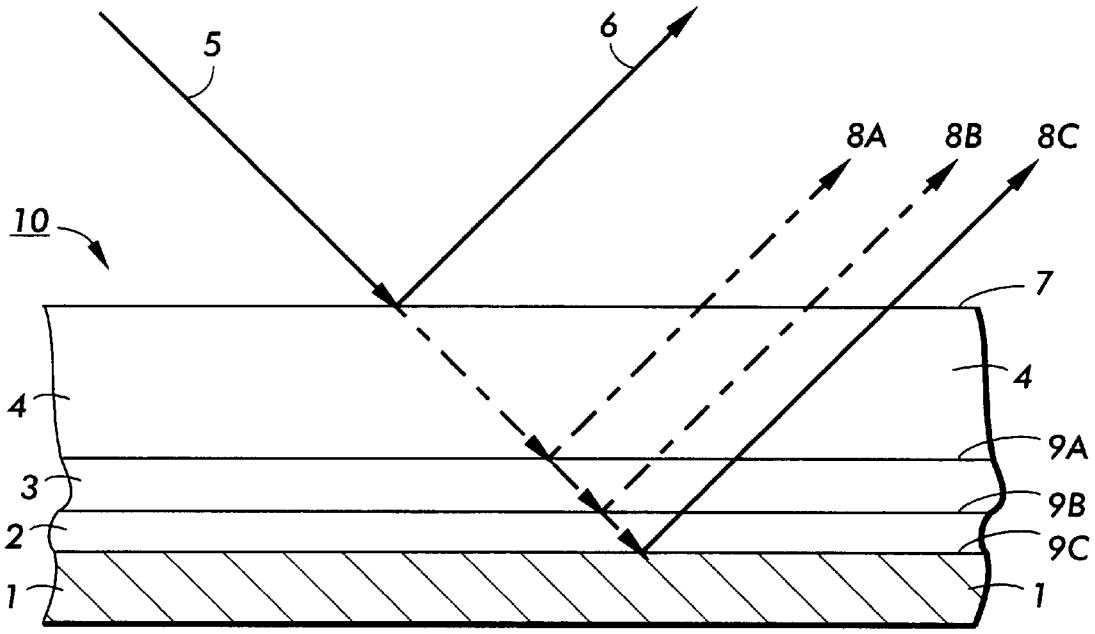
FIG. 1 PRIOR ART
FIG. 1 is a schematic cross-sectional view showing the primary reflections that contribute to the interference effect in a multilayered conventional device.

As compared with the prior art photoreceptor of FIG. 1, the photoreceptor illustrated in FIG. 2 does not generate a strong specular reflection from the interface 23 between the substrate and the metal oxide layer because of the light scattering effect by the diamond lathed roughened surface of the substrate. It is important to point out that the reflection lights, 8A from the charge transport layer/charge generating layer interface and 8B from the charge generating layer/undercoat layer interface, are shown in broken lines because they have very weak reflection intensity due to the fact that these layers have closely matched refractive indexes and the entering light beam can substantially travel in a straight line without actually being distorted. Since the problem of interference fringes can be effectively resolved if the primary specular reflection 6 or 8C, either from the charge transport layer surface or from the substrate surface, is eliminated or suppressed, it has been demonstrated in the present invention that by creating a substrate surface with the desired surface roughened characteristics, the intensity of this primary specular reflection is suppressed due to the light scattering effect shown in FIG. 2. The technique by which the specular reflection 8C is minimized or suppressed will now be described.

To eliminate or minimize interference between the substrate and the metal oxide layer interface, the substrate 11 is formed to include a surface texture that is described by a set of parameters: the core roughness depth, $R_k$, found in the Abbott-Firestone curve or the Material Ratio Curve; the arithmetic mean roughness, $R_a$; the arithmetic mean of the five highest peaks to the five deepest valleys in a given sampling length, $R_{ZISO}$; the maximum roughness depth, $R_{max}$; and Peak Count $R_{t1(o.1)}$. Each of these parameters is described in detail below.

Figure 3:
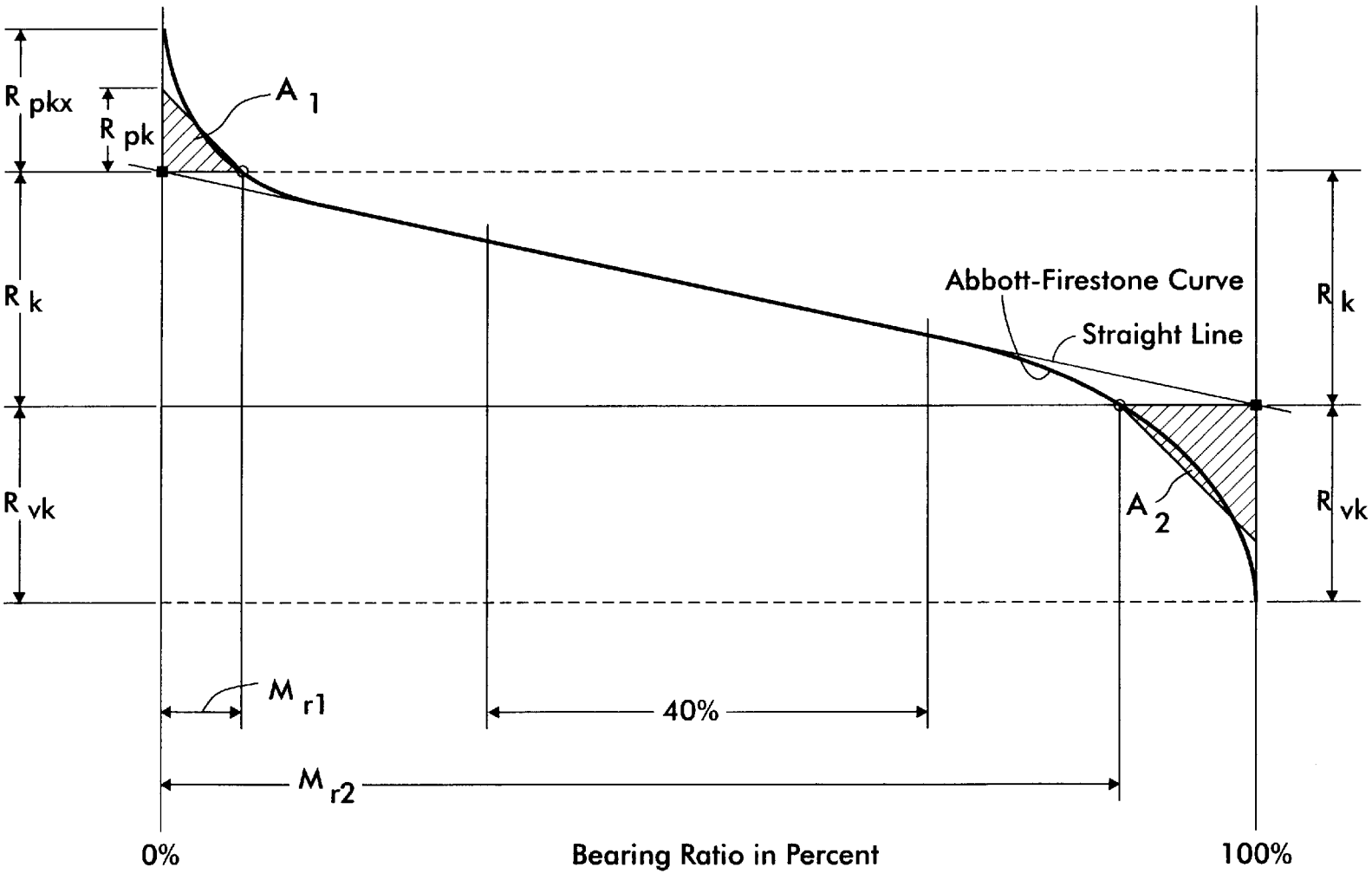
FIG. 3 illustrates the Material Ratio Curve or Abbott-Firestone curve.

FIG. 3 illustrates the Material Ratio Curve, which is the graphical representation of material ratio calculated throughout the depth of the profile. $R_k$ is the depth of the core roughness profile for which the Material Ratio Curve can be closely approximated by a bestfit straight line which is determined by a secant to the Material Ratio Curve representing the smallest rise over a material ratio range of 40%. $R_a$ is the arithmetic average of all departures of the roughness profile from the center line within the evaluation length. $R_a$ is defined by a formula:

$$R_a = \frac{1}{l_m}\int_0^{l_m} |y| dx$$

in which $l_m$ represents the evaluation length, and |y| represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard.

$R_{zso}$ can be defined by a formula:

$$R_{ZISO} = \frac{1}{5}\sum_{i=1}^{5} Y_{pi} + \sum_{i=1}^{5} Y_{vi}$$

in which $Y_{pi}$ represents the value of departure of the roughness profile above the center line from the center line, and $Y_{vi}$ represents the value of departure of the roughness profile below the center line from the center line Peak count $R_{t1(x)}$ is defined as the number of peaks which have risen above the upper reference level and have fallen adjacently below the lower reference level. Peak count is always related to a length of 10 mm. The reference level is determined by the value of x and the upper and lower reference levels are symmetrical to the center line. The reference level is therefore 0.1 micron for $R_{t1(0.1)}$.

These measurements may be made with a profilameter such as Model S8P manufactured by Mahr Feinpruef Corporation. Generally, a stylus with a diamond tip is traversed over the surface of the roughened substrate at a constant speed to obtain all data points within an evaluation length. The radius of curvature of the diamond tip used to obtain all data referred to herein is 5 microns.

For the present invention, the following surface roughness parameters are preferred: $R_k$ is in the range of about 0.1 to about 1.0 micron and preferably between 0.4 to about 0.7 micron, $R_{ZISO}$ is in the range of about 1.0 to about 2.0 micron and preferably between about 1.2 to about 1.5 micron, $R_a$ is in the range of about 0.05 to about 0.5 micron and preferably between about 0.1 to about 0.25 micron, $R_{max}$ is below about 4 micron and preferably below about 2 micron, and $R_{t1(0.1)}$ is greater than about 200 counts and preferably greater than about 300 counts. In embodiments, $R_k$ is in the range of from about 0.4 to about 0.6 micron; $R_{ZISO}$ is in the range of from about 1.3 to about 1.6 micron; $R_a$ is in the range of from about 0.15 to about 0.25 micron.

The surface roughness parameters described herein may be achieved in embodiments with the etching procedure alone, but preferably with a combination of a lathing process using for example a diamond tipped tool and the etching procedure using the etching solution. The typical operating ranges for the diamond lathing process are as follows: the lathing speed or the feed rate is between about 0.05 to about 0.2 mm/revolution; the rotating speed is between about 2000 to about 4000 rpm; and the horizontal speed is between about 700 to about 2000 mm/min. The diamond can be either single crystalline or polycrystalline.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

A solution (referred herein as the chemical solution) of the following formulation was prepared for treating an aluminum substrate prior to applying photoconductive coatings:

1% (wt) Sodium Hydroxide (NaOH);

1% (wt) Sodium Carbonate ($Na_2CO_3$); and

1% (wt) Sodium Tetraborate Decahydrate ($Na_2B_4O_7.10H_2O$).

The salts were thoroughly dissolved in deionized water and the bath temperature raised to 38° C.

A seamless drawn 3003 aluminum alloy cylindrical substrate, lathe turned to yield a highly reflective surface with an arithmetic mean roughness ($R_a$) of about 0.05 micron, was immersed in the chemical solution for 3 min. Subsequently, the substrate was withdrawn, immersion rinsed in ambient deionized water for 1 min., withdrawn, immersed in 70° C. deionized water for 1 min., withdrawn and dried at 60° C. for 3 min. This process produced a uniformly matte etched surface having an aluminum oxide film of about 200 Angstoms in thickness (Electron Spectroscopy for Chemical Analysis, or, ESCA) characterized by a yellow-red color when viewed obliquely.

The substrate was then coated with an about 0.2 micron thick charge, generating layer of hydroxygallium phthalocyanine (referred herein as OHGaPc) and a terpolymer (referred herein as VMCH) of: vinyl chloride (83%), vinyl acetate (16%) and maleic anhydride (1%), dissolved in n-butyl acetate (4.5% solids) in a 60 (OHGaPc): 40 (VMCH) ratio. Atop the charge generating layer was coated a 24 micron thick charge transport layer of polycarbonate, derived from bisphenyl Z (PCZ400) and N,N'-diphenyl-N, N'-bis(3-methylphenyl)-(1,1'-biphenyl)4,4' diamine dissolved in tetrahydrofuran.

After coating and drying, the resulting photoreceptor was electrically arid copy quality tested in comparison to an equivalent of a Hewlett-Packard 4 photoreceptor (referred herein as the control). The inventive photoreceptor was charged to 400 volts and again to 800 volts then exposed to various light exposures to develop the photoreceptor induced discharge characteristics. The inventive photoreceptor was observed to charge within 97% of the control and discharged to levels 10% lower than the control. Dark decay and contrast potentials of the inventive photoreceptor were comparable to the control. The copy quality of the inventive photoreceptor was judged to be satisfactory and comparable to the control with no interference-fringe print defects and some improvement in solid area density.

EXAMPLE 2

A second inventive photoreceptor was prepared using the same procedures of Example 1 with the exception that a 1.5 micron thick undercoat blocking layer (nylon 8) was formed between the metal oxide blocking layer and the charge blocking layer. In this case all electrical and copy quality test results of the second inventive photoreceptor were essentially the same as the inventive photoreceptor of Example 1. Thus, the second inventive photoreceptor was judged to be satisfactory and comparable to the control with no interference-fringe print defects.

Comparative Example

A comparative photoreceptor was prepared using the same procedures of Example 1 with the exception that the substrate was not treated with the chemical solution, i.e., no metal oxide blocking layer was formed on the substrate.

When tested for copy quality, this comparative photoreceptor showed unacceptable and extensive levels of the intereference-fringe print defect.

Other modifications of the present invention may occur to those skilled in the art based upon a reading of the present disclosure and these modifications are intended to be included within the scope of the present invention.

What is claimed is:

1. A photoreceptor fabrication method involving a photoreceptor substrate having a metal surface, comprising etching the metal surface of the photoreceptor substrate with an etching solution and forming a metal oxide layer on the metal surface with the etching solution, wherein the etching of the metal surface and the forming of the metal oxide layer are conducted in the absence of an electric current wherein the metal surface is aluminum or aluminum alloy and the metal oxide layer is an aluminum oxide layer.

2. The method of claim 1, wherein the metal surface is aluminum or aluminum alloy.

3. The method of claim 1, wherein the metal oxide layer is an aluminum oxide layer.

4. The method of claim 1, wherein the etching solution comprises sodium citrate.

5. The method of claim 1, wherein the etching solution comprises sodium citrate at a concentration ranging from about 1% to about 10% by weight.

6. The method of claim 1, wherein the etching solution comprises sodium carbonate, sodium borate, and sodium hydroxide.

7. The method of claim 1, wherein the etching solution comprises sodium carbonate at a concentration of about 3% by weight, sodium borate at a concentration of about 3% by weight, and sodium hydroxide at a concentration of about 1% by weight.

8. The method of claim 1, further comprising lathing the metal surface of the photoreceptor substrate to roughen the metal surface prior to etching the metal surface with the etching solution.

9. The method of claim 1, further comprising exposing the metal oxide layer to an elevated temperature to increase the thickness of the metal oxide layer.

10. The method of claim 9, wherein the elevated temperature ranges from about 100 to about 300° C.

11. The method of claim 1, further comprising depositing a photosensitive layer on the photoreceptor substrate subsequent to the formation of the metal oxide layer on the metal surface.

12. The method of claim 1, wherein the metal oxide layer is a charge blocking layer.

13. The method of claim 1, wherein the metal oxide layer has a thickness ranging from about 10 to about 200 angstroms.

14. The method of claim 1, wherein the metal oxide layer has a thickness ranging from about 100 to about 200 angstroms.

* * * * *